US005255540A

United States Patent [19]

LeBlanc et al.

[11] Patent Number: 5,255,540

[45] Date of Patent: Oct. 26, 1993

[54] PRESSURIZED DYNAMIC WASHER

[75] Inventors: Peter LeBlanc, Seminole, Fla.; Goda Rangamannar, Pittsfield, Mass.

[73] Assignee: Beloit Technologies, Inc., Wilmington, Del.

[21] Appl. No.: 546,119

[22] Filed: Jun. 29, 1990

[51] Int. Cl.[5] ..... D06B 3/00

[52] U.S. Cl. ..... 68/181 R; 162/60

[58] Field of Search ..... 162/60, 380, 57, 56; 210/415, 416.1, 497.01; 68/181 R

[56] References Cited

U.S. PATENT DOCUMENTS

| | | | |
|---|---|---|---|
| 3,363,759 | 1/1968 | Clarke-Pounder | 209/273 |
| 3,437,204 | 4/1969 | Clarke-Pounder | 209/273 |
| 3,735,873 | 5/1973 | Bergstedt | 210/415 |
| 4,043,919 | 8/1977 | Hutzler | 210/415 |
| 4,396,502 | 8/1983 | Justus | 210/415 |
| 4,529,479 | 7/1985 | Tuomi | 162/29 |
| 4,855,038 | 8/1989 | LeBlanc | 210/415 |

*Primary Examiner*—W. Gary Jones
*Assistant Examiner*—Brenda Lamb
*Attorney, Agent, or Firm*—Dirk J. Veneman; Raymond W. Campbell

[57] ABSTRACT

A pressurized dynamic pulp washer in which stock is driven along a stationary wash wire and pulses are generated in the stock to urge liquid through openings in the wash wire. Wash liquid is introduced countercurrent to the flow of stock, and localized mixing and reslurrying occurs.

17 Claims, 2 Drawing Sheets

PRESSURIZED DYNAMIC WASHER

BACKGROUND OF THE INVENTION

The present invention relates to improvements in pulp washers and, more particularly, to an improved method and mechanism for washing cellulose pulp fibers.

When wood is chemically processed to obtain cellulose pulp fibers for papermaking, the process includes cooking or digesting wood chips with various pulping liquors so that the resins and materials binding the cellulose fibers together are dissolved in the pulping liquor, thereby liberating the fibers. The result is a slurry of fibers suspended in a liquid of water and spent chemicals or liquor. To further prepare the pulp for papermaking, the fibers must be separated from the liquid, the liquid removed and the fibers washed to remove what chemicals remain with the fiber.

PRIOR ART

The goal of pulp washing is to separate soluable impurities from the pulp fiber, to obtain pulp essentially free from impurities. An optimum pulp washing system would remove waste liquor and other impurities completely, while using only a minimal amount of wash liquid. For chemical recovery and/or other subsequent waste liquor processing, any wash fluids added during the washing stage must also be treated, either by evaporation or by other means. Therefore, it is desirable to minimize the amount of wash fluid added during the washing process, to minimize dilution of the pulping liquors and the subsequent cost of reprocessing the chemicals in subsequent treatment stages.

In evaluating the efficiency of washing systems, the papermaking industry has adopted the term "dilution factor" to define the amount of wash fluid used. The dilution factor can be described as the amount of water or other wash liquid put into the system and not taken out of the system with the washed pulp as the pulp is removed from the system. If the quantity of wash fluid added is equal to the quantity of wash fluid passing from the system with the pulp, the dilution factor is zero. Low dilution factors are, therefore, most desirable.

Methods used heretofore for the washing of cellulose stock are discussed below:

DILUTION—AGITATION—EXTRACTION (EXTRACTION WASHING)

In this washing process, excess liquor is drained from the pulp, and the pulp is diluted with water and/or weaker liquor from a following stage. The mixture is thoroughly agitated to promote equilibrium. The mixture is then again dewatered to a predetermined extent. The process efficiency is related to the degree of equilibrium reached in the agitation cycle, and the degree of extraction between successive dilution stages. Compaction may be used to enhance the extraction stage. The removal of solids and weak black liquor concentrations in extraction washing is dependent on the inlet and discharge consistencies of the pulp for a given dilution factor.

Extraction washing systems usually require a plurality of extraction stages to accomplish acceptable washing results, and have inherently high dilution factors. Present day chemical recovery practices and environmental standards have reduced the acceptance of this washing technique.

DISPLACEMENT WASHING

In this method, the liquor within the slurry void spaces is displaced with wash water and/or filtrate from following stages. Diffusion of the wash liquid through the pulp is controlled to avoid mixing. The process efficiency is related to the degree of mixing and channelling that occurs during displacement, which decreases efficiency, and the degree of equilibrium reached between pulp fibers and liquor pockets and wash liquor.

Methods for performing displacement washing have included forming a mat of the stock on the top surface of a rotating perforated drum or a traveling belt and spraying the displacement liquid onto the top of the mat. The liquid passing through the belt is removed from beneath the belt. A substantial disadvantage in this type of arrangement has been the creation of foam and froth on the top of the wire, which has to be removed and handled. Further, protective hoods or canopies have to be provided to handle the spray.

DILUTION—EXTRACTION—DISPLACEMENT

This method utilizes combined operations of the previous two methods, and its efficiency is dependent on the variables affecting the operation of each. Approximately 85% of the Kraft pulp mills today use this method for pulp washing. The pulp is diluted with the liquor from the following stage, and is agitated to promote equilibrium. Extraction occurs, followed by the displacement of the liquor remaining in the pores. Drum washers, either pressurized or under vacuum, have been used to perform this washing method. As with the earlier described methods, with respect to the washing surface, the pulp fibers are more or less in a static state as the extraction and displacement occur.

Some of the difficulties with this method include the negative effects of entrained air in the pulp and, in the case of vacuum washers, the limitations on washing temperature. Generally, drainage of liquor through a pulp mat improves with elevated temperatures, and higher temperatures therefore improve washing efficiency. However, vacuum washers, which operate with up to −5 psi in the drum, create lower equilibrium temperature conditions. Therefore, it is not possible to significantly raise the operating temperature of vacuum washers to further improve the drainage characteristics of the pulp.

Pressure washers operating similarly to vacuum washers, but with a positive pressure in a hood above the pulp mat, have overcome, to some degree, the temperature limitations of vacuum washers. However, as with vacuum washers, the stock surface is exposed to air, and the ability to control the washing process by the stock pressure is lost. Further, air entrainment in the stock is significant, and foam resulting from the entrained air, at times, is difficult to control. Air in the pulp reduces the efficiency of subsequent wash stages, further increasing the washing capacity required to reach the desired degree of washing. Defoaming agents are helpful, but add cost and present additional handling and disposal problems.

Previously known washing techniques employing extraction or displacement have maintained relatively static relationships between the fibers being washed and the retention surface through which the separation occurs. Typically, today, this includes the formation of a mat on a wire, drum or the like. As the liquid is removed, the mat is stationary with respect to the drum or wire. The resulting relatively slow extraction or displacement requires equipment to be large for adequate capacity. Therefore, capital expense for equipment and space requirements are large.

OBJECTS OF THE PRESENT INVENTION

An object of the present invention is to provide a continuously operating mechanism and method for the washing of cellulose stock which avoids disadvantages of methods and structures heretofore available, and which is capable of performing a washing operation without the generation of froth and foam.

A further object of the present invention is to provide an improved stock washing mechanism and method which improves the quality of the stock being washed, and which utilizes the carrier liquid in the stock for washing and subjects the fibers to a continuous reslushing and rewashing process with agitation while addition of fresh wash liquid is minimized, resulting in a minimum dilution of the liquor.

A still further object of the present invention is to provide a stock washer which has an improved arrangement for handling the liquors and liquid and an improved arrangement for removing the stock fibers.

Another object of the present invention is to provide a stock washer operating under a pressurized atmosphere to handle high temperature stock and also to improve the washing operation efficiency.

Yet another object of the present invention is to provide a stock washing apparatus which keeps the stock under high turbulence at high consistency for improved washing operation efficiency.

Still another object of this invention is to provide a stock washing apparatus and method which reduce the area required for washing equipment and which achieve economy of piping and pumping, and decreased capital investment for washing equipment in comparison with existing washing techniques for a given degree of washing.

SUMMARY OF THE INVENTION

The present invention provides a method and apparatus for washing pulp stock in an enclosed atmosphere under pressurized conditions wherein the stock is driven along a stationary barrier or washer wire by the pressure differentials between the stock inlet and stock outlet of the washer. Fresh wash liquid is admitted at the stock outlet end and flows counter current to the stock which is repeatedly formed, agitated, diluted and washed as it moves along the stationary barrier. Filtrate is driven by the pressure differentials across the barrier, which restricts the passage of fiber therethrough. A rotor generates high frequency, low amplitude pulses in the stock as the stock passes along the wire and creates localized mixing, reslurrying and washing of the fiber.

Other objects, advantages and features of the invention, as well as alternative embodiments of the structures and methods, will become more apparent with the description of the principles of the invention in connection with the disclosure of the preferred embodiments in the specification, claims, and drawings.

DETAILED DESCRIPTION OF THE PREFERRED EMBODIMENT

Figure 1:
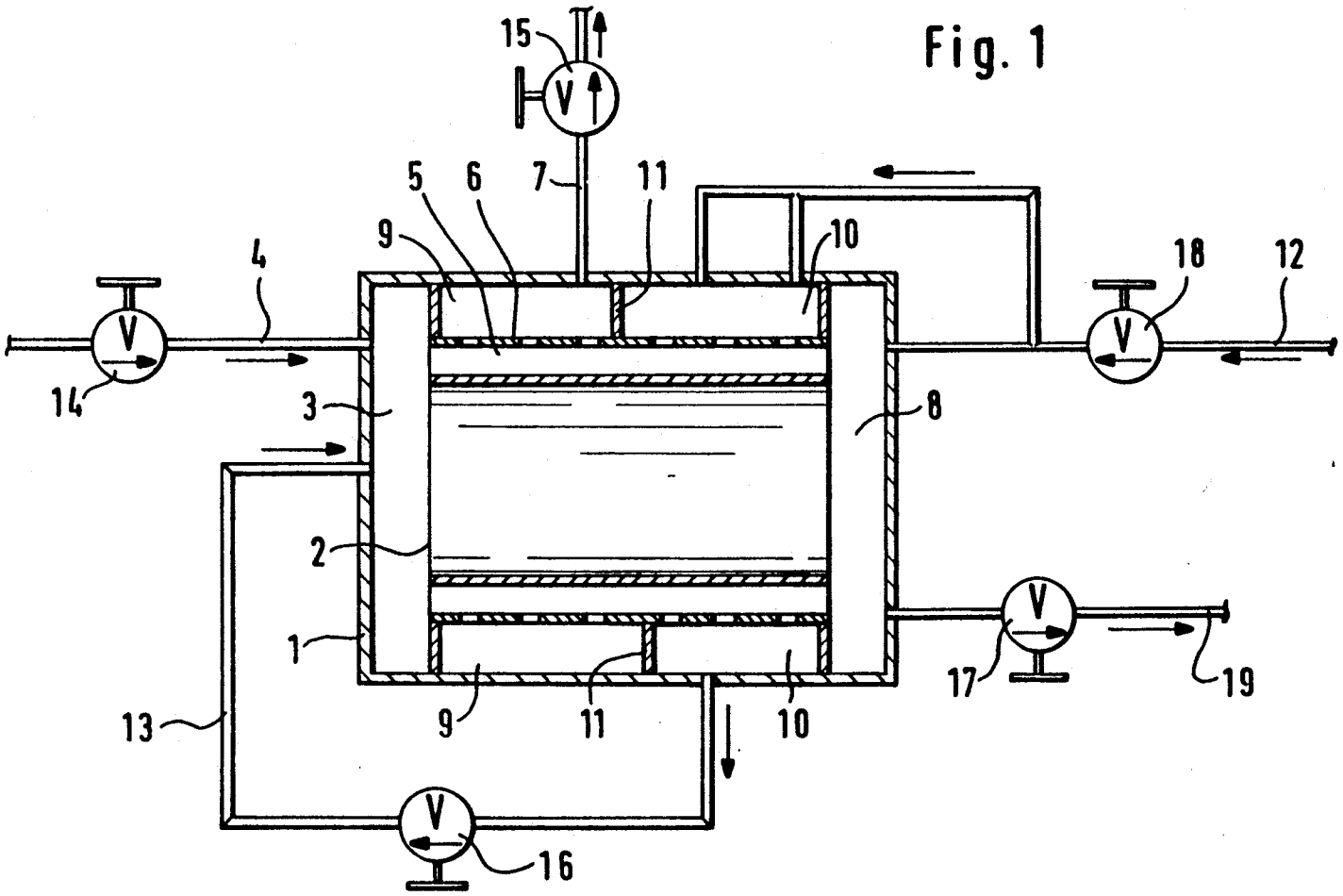
FIG. 1 is a vertical sectional schematic representation which shows a generic stock washing mechanism constructed and operating in accordance with the principles of the present invention.

Referring now more specifically to the drawings, and to FIG. 1 in particular, the pressurized dynamic washer of the present invention includes a body (1) and a rotor assembly (2) axially disposed in the body. The main shell or body (1) is divided into three major zones. The first is an inlet zone (3) located at the front of the washer, generally at the end of the rotor. An inlet pipe (4) enters the inlet zone in a tangential manner at the top of the shell, to supply stock to the washer under velocity tangential to the washer axis.

The second zone within the body (1) is a washing zone (5), which may be separated into several subzones at the outer shell area for the extraction of wash liquors. A cylindrical washer wire or barrier (6) is disposed along the washing zone, isolating a filtrate pipe (7), located at the top of the shell, from the rotor assembly (2) axially disposed within the washer and wash wire. Thus, only the wash liquor passing through the wash wire will reach the filtrate pipe. The wash wire forms a barrier along which separation of the fiber from the liquor occurs.

The third zone of the body is an outlet zone (8), located at the rear of the washer, at an opposite end of the rotor and wire from the inlet zone, and is the area where the washed stock is discharged from the washer.

The washing zone of the washer is shown to have two compartments, (9) and (10), behind the wash wire. These compartments are separated from each other by a baffle (11). The wash water is introduced at the rear side of the washer through a pipe (12). The quantity of fresh water added is controlled by a control valve (18). The liquor in the stock is displaced by the fresh water and is extracted through the wash wire into compartment (10). The stock, after washing, is discharged from the washer through stock line (19). The filtrate from compartment (10) is introduced at the inlet side of the washer through a pipe (13) without the aid of a pump, purely on the basis of pressure differentials. The pressure at the central zone of the washer is lower than the pressure at the discharge point of the filtrate from compartment (10). It will be recognized, however, that pumps can be used.

The filtrate introduced at the inlet side of the washer through the pipe (13) is used for internal dilution. Since the filtrate has a lower solute concentration than the liquor already present in the stock as the filtrate displaces the higher solute concentrated liquor in this zone, which is transported to compartment (9) through the wash wire, the stock fiber is freed from a quantity of soluable impurities. The higher concentrated liquor in compartment (9) is discharged from the washer through filtrate pipe (7).

The flow through inlet pipe (4), high concentration filtrate line (7), filtrate recirculation pipe (13), washed stock outlet line (19) and fresh water pipe (12) are controlled by valves (14), (15), (16), (17), and (18) respectively, to maintain steady state operation of the washer by creating pressure differentials across the wire, between inner and outer areas and also across the washer between the stock inlet and washed stock outlet.

Figure 2:
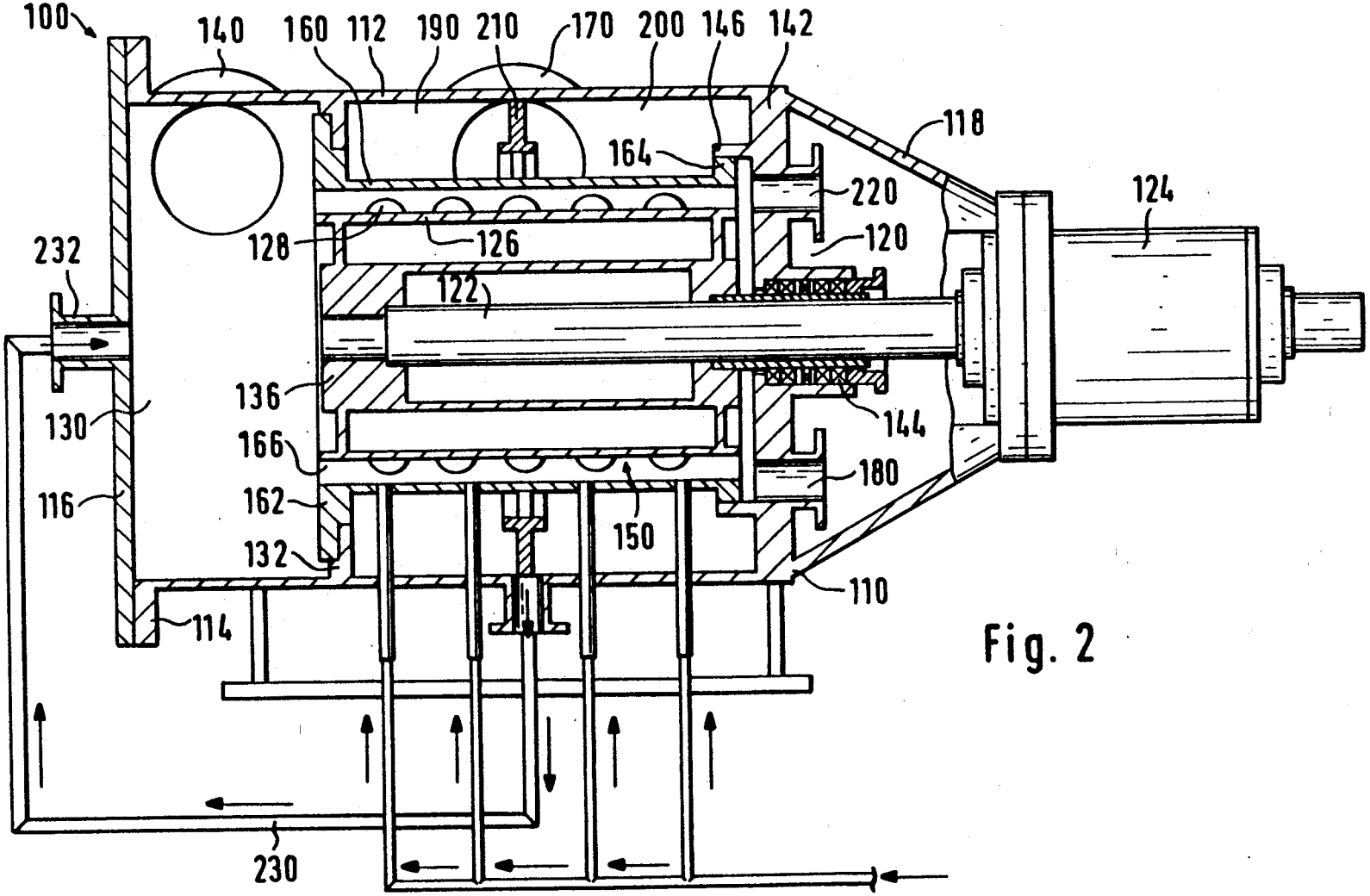
FIG. 2 is a vertical cross-sectional view taken through a preferred embodiment of a dynamic pulp washer which operates in accordance with the principles of the present invention.

With reference now to FIG. 2, a more specific description will be made of a preferred embodiment for the pressurized dynamic washer disclosed with respect to the schematic of FIG. 1. In FIG. 2, numeral 100 designates a pressurized dynamic washer constructed to operate in accordance with the principles of the present invention. A fabricated body (110) of, preferably, stainless steel or the like, includes an outer substantially cylindrical shell (112) having a flange (114) for receiving a cover (116) at the inlet end of the washer. The body (110) further includes a substantially conically-shaped portion (118) at the outlet end of the washer.

A rotor assembly (120) is generally disposed along the axis of the body (110), and includes a rotor shaft (122) drivingly attached to a motor (124) and connected to a rotor body (126) having a plurality of knobs or bumps (128) on the outer surface thereof. The rotor, thus far described, is frequently referred to as a fractionating type rotor, which generates high frequency, low amplitude pulses in the stock. The bumps (128) may be hemispherical or of other shape.

An inlet zone (130) is defined generally by the cover (116), a portion of the shell (120), an internal shell flange (132) and an end (136) of the rotor body (126). An inlet pipe (140) provides a slurry of the stock to be washed to the inlet zone (130). The orientation of inlet pipe (140) with respect to the rotor, rotor axis and inlet zone is such as to provide significant tangential velocity to the stock.

An internal wall (142) of the shell (112) supports the rotor assembly (120) on bearings (144) receiving the rotor shaft (122). Wall (142) includes a flange (146). The flange (132) at one end of the washer, and the flange (146) at the other end of the washer define, generally, the inlet and outlet extreme locations of a washing zone (150) which receives stock from the inlet zone (130).

A wash wire (160) is connected to the flanges (132) and (144) by wash wire mounting flanges (162) and (164), respectively. The washing wire (160) is a cylindrical, perforate basket, preferably smooth, and having holes or slots sufficiently small to limit the passage of cellulose fibers under the pulses from the rotor assembly (120). Slots measuring 0.006 inch in a smooth basket design have been found to work well; however, slots within the range of from about 0.002 inch to about 0.012 inch and holes within the range from about 0.004 inch to about 0.012 inch are suitable.

Wash wire (160) forms a stationary barrier along which the stock flows from the inlet end of the washer to the outlet end. The washer wire is closely spaced from the rotor body (126) with its bumps (128) thereon, and separates the washing zone (150) into radially inner and radially outer portions. Stock from the inlet zone (130) enters the radially inner portion of the washing zone through a space (166) between the rotor and the inner surface of the wash wire. Liquids displaced from the stock flow through the slots in the wire to the radially outer portion of the washing zone (150). Some or all of the displaced liquids can be conducted from the washer through a filtrate outlet (170), while washed stock is conducted from the washer through a washed stock outlet (180).

The radially outer portion of the washing zone (150) is divided into subzones (190) and (200) by a baffle (210). It should be recognized that two or more baffles such as baffle (210) may be used to provide three or more washing subzones similar to subzones (190) and (200).

Stock which enters the space (162) between the outer surface of the rotor assembly (120) and the inner surface of the wash wire (160) flows along the wash wire due to maintained pressure differential between inlet and outlet pressures. A wash liquid line (220) is provided in the wall (142) and supplies wash liquid which displaces the liquor in the stock, which liquor is extracted through the wash wire into the subzones (190) and (200). A filtrate recirculation line (230) conducts filtrate from subzone (200) to a filtrate recirculation inlet (232) in the cover (116).

The fibers to be washed are fed in the form of a stock slurry by supply means not shown to the inlet pipe (140), with the stock being discharged tangentially to the washer at the inlet zone (130). A stock slurry of liquor and fiber of about 0.2 to 4.5% consistency, and preferably from 3.0 to 3.5% consistency, at temperatures up to 200° F. is fed to the washer.

The fiber slurry enters the washing zone (150) through the space (162). The fibers are forced to move along the wash zone 150 is a path substantially parallel to washer wire (160). It is difficult for fibers to pass through the wire because of the approach angle of a fiber to a slot. The fibers travel in the axial direction from the inlet zone (130) to the washed stock outlet (180) of the washer.

There are three primary velocities acting inside the washer to aid the mechanism of washing. These components are the axial, radial and tangential velocities. The axial velocity is along the axis of rotation of the washer and generally parallel to the wash surface of the wash wire. This velocity is controlled by the pressure differential between the stock inlet and the washed stock outlet. This axial velocity is affected by the size of annulus between the wash wire and the body of the rotor, and on the volume of flow towards the stock outlet.

The radial velocity is toward and through the washer wire. This velocity is controlled by the pressure differential between the stock inlet and the wash filtrate outlet. The radial velocity depends upon the total area of the washer wire, the open area in the wire and on the volume of filtrate flow.

The tangential velocity is the rotational velocity of the stock about the axis of the washer. The tangential velocity depends to a large extent upon rotor design.

The velocities in the washer produce radial drag forces, shear forces and turbulent forces which together mix, reslurry and dewater the stock to achieve the desired degree of washing efficiency in the washing zone.

Because of the transverse velocity, which is a combination of the velocities created in the washer, the effective size of wire opening as presented to fibers flowing through the washer is reduced. This reduction of apparent wire opening is an important mechanism for the efficient separation of liquid from the stock. The differential pressure created between the interior of the washer and the filtrate chamber drives the liquid through the washer wire. However, the fibers, being influenced by the transverse velocity, will not pass through wire openings which would allow fiber passage if the fibers were influenced only by radial velocity. The stock inside the washer reaches higher consistency than the inlet consistency due to the extraction of liquid.

The stock in the washing zone is exposed to several washing mechanisms, including dilution, mixing, extraction and displacement. The process efficiency depends upon the degree of equilibrium reached in mixing and the degree of extraction and displacement achieved under a particular operation condition of the washer. High degree of mixing is achieved in this washer due to the operation of a high speed rotor in close proximity with the wash wire. This quickly produces a uniform concentration of solute at any point of the washer, when a high solute concentrated liquor in the stock is mixed with a low solute concentrated liquor or fresh water. This liquor, after achieving equilibrium concentration, is extracted through the wire.

Although the device described here consists of two stages of washing, it is obvious to one skilled in the art that this may be extended to incorporate any number of stages within a single system.

The present dynamic washer generates a turbulent, fluidized displacement as compared tot he static displacements known previously. Displacement is more efficient and the present washer may be about one-third the physical size of a comparable drum washer.

Thus, it can be clearly seen from the description provided that an improved washer and washing method, which provide the objectives and features above set forth, are provided. It should be recognized, however, that various changes may be made without departing from the scope of the present invention.

I claim:

1. A wood pulp fiber washing device comprising:

a hollow body defining a pressurizable compartment for receiving a slurry flow of pulp fibers in a carrying liquid, said body having a slurry inlet means and a slurry outlet means;

a stationary wash wire disposed in said compartment;

said slurry inlet and outlet means both being in flow relationship with one side of said wash wire such that pulp fibers entering said device from said slurry inlet means pass through said slurry outlet means without passing through said wire;

pulse means for generating pulses operationally disposed near, but spaced from said wash wire, for generating high frequency, low amplitude pulses in slurry passing along said wash wire, and for localized mixing of the slurry along said wash wire;

said wash wire being structured and arranged in cooperation with said pulse means so as to create a barrier to the passage of pulp fibers from said one side of said wire to an opposite side of said wire, but allowing carrying liquid to pass therethrough;

delivery means for delivering slurry to the space between said means for generating pulses and said wash wire;

supply means for introducing wash liquid to displace and replace liquid passing through said wash wire;

means for creating axial velocity in the direction from inlet to outlet in said washer; and radial velocity generating means for dewatering the pulp stock traveling along the wire.

2. A wood pulp fiber washing device as defined in claim 1, in which said wash wire is substantially cylindrically shaped.

3. A wood pulp fiber washing device as defined in claim 2, in which said means for generating pulses includes a rotor axially disposed in said cylindrically shaped wash wire.

4. A wood pulp fiber washing device as defined in claim 3, in which said rotor includes a substantially cylindrical surface having a plurality of outwardly extending projections.

5. A wood pulp fiber washing device as defined in claim 4, in which said projections are substantially hemispherically shaped.

6. A wood pulp fiber washing device as defined in claim 3, in which said delivery means is disposed at one end of said wash wire to introduce said slurry at said one end of said wash wire, and said supply means is disposed at a second end of said wash wire opposite said first end, to introduce wash liquid at said second end of said wash wire.

7. A wood pulp fiber washing device as defined in claim 6, in which a liquid collecting chamber is provided in said body for collecting at least some of said liquid passing through said wash wire near said second end of said wash wire, and a recirculation line is provide for introducing at least some of the collected liquid to said washing device near said one end of said wash wire.

8. A wood pulp fiber washing device as defined in claim 1, in which said delivery means is disposed at one end of said wash wire to introduce said slurry at said one end of said wash wire, and said supply means is disposed at a second end of said wash wire opposite said first end, to introduce wash liquid at said second end of said wash wire.

9. A wood pulp fiber washing device as defined in claim 8, in which a liquid collecting chamber is provided in said body for collecting at least some of said liquid passing through said wash wire near said second end of said wash wire, and a recirculation line is provide for introducing at least some of the collected liquid to said washing device near said one end of said wash wire.

10. A pressurized dynamic pulp washer comprising:

a hollow pressurizable housing including means for receiving a slurry of pulp fibers to be washed;

a cylindrical, stationary wash wire disposed in said housing, said wash wire having openings therethrough;

a rotor axially disposed in said cylindrical wash wire and operationally connected to drive means for rotating said rotor about its longitudinal axis;

said rotor and said wash wire being minimally spaced from each other, thereby defining an annulus between them through which slurry may flow;

receiving means radially outwardly from said wash wire for receiving liquid passing through said wash wire;

supply means for introducing a slurry of pulp fibers to be washed into said annulus at one end of said wash wire and said rotor;

means for generating tangential, radial, and axial velocities in said slurry passing through said annulus, said means for generating being structured and arranged in cooperation with said wash wire such that a barrier is formed through which liquid but not pulp fibers pass readily; and wash liquid supply means for introducing wash liquid to replace liquid passing through said wash wire.

11. A pressurized dynamic pulp washer as defined in claim 10, in which said rotor includes a plurality of substantially radially extending projections.

12. A pressurized dynamic pulp washer as defined in claim 10, in which said rotor includes a plurality of substantially hemispherically shaped projections on the outer surface thereof.

13. A pressurized dynamic pulp washer as defined in claim 10, in which a wash liquid inlet means is provided at an end of said cylindrical wash wire, opposite said one end.

14. A pressurized dynamic pulp washer as defined in claim 13, in which said receiving means includes at least first and second compartments, said first compartment being generally closer to said end of said wash wire at which said slurry is introduced to said annulus, and said second compartment is generally closer to said end of said wash wire at which said wash liquid is introduced.

15. A pressurized dynamic pulp washer as defined in claim 14, in which a recirculation circuit is provided for reintroducing at least some of the liquid collected into said washer at said one end.

16. A pressurized dynamic pulp washer as defined in claim 10, in which said receiving means includes at least first and second compartments, said first compartment being generally closer to said end of said wash wire at which said slurry is introduced to said annulus, and said second compartment is generally closer to said end of said wash wire at which said wash liquid is introduced.

17. A pressurized dynamic pulp washer as defined in claim 16, in which a recirculation circuit is provided for reintroducing at least some of the liquid collected into said washer at said one end.

* * * * *